United States Patent [19]

De Guise

[11] 4,334,671

[45] Jun. 15, 1982

[54] GUARD-RAILS ASSEMBLY

[76] Inventor: Yvon De Guise, 37 Fleury, Vimont, Laval, Quebec, Canada

[21] Appl. No.: 61,862

[22] Filed: Jul. 30, 1979

Related U.S. Application Data

[63] Continuation-in-part of Ser. No. 962,553, Nov. 20, 1978, abandoned.

[30] Foreign Application Priority Data

Dec. 9, 1977 [CA] Canada ..... 292830

[51] Int. Cl.[3] ..... B21F 27/00

[52] U.S. Cl. ..... 256/65; 256/22

[58] Field of Search ..... 256/22, 59, 65

[56] References Cited

U.S. PATENT DOCUMENTS

| | | | |
|---|---|---|---|
| 1,376,150 | 4/1921 | Miller . | |
| 3,411,752 | 11/1968 | Bos | 256/22 |
| 3,420,504 | 1/1969 | Mulitz | 256/22 |
| 3,420,505 | 1/1969 | Jefferys | 256/22 |
| 3,485,006 | 12/1969 | De Rozario | 52/731 |
| 4,014,520 | 3/1977 | Walters | 256/22 |
| 4,073,477 | 2/1978 | Walters | 256/22 |

FOREIGN PATENT DOCUMENTS

| | | | |
|---|---|---|---|
| 778130 | 2/1968 | Canada | 256/65 |
| 2102577 | of 1972 | France . | |

*Primary Examiner*—Andrew V. Kundrat

*Attorney, Agent, or Firm*—Fleit & Jacobson

[57] ABSTRACT

A fabricated, assembled railing having identical top and bottom rails and bars fixed to, and extending perpendicular to, the rails. Each rail comprises inner and outer rail members. The rail members are channel shaped and the ends of the bars pass through the webs of the inner rail members to be joined to the outer rail members while the inner rail members are themselves joined to the outer rail members. A method for assembling the railing is also directed.

4 Claims, 12 Drawing Figures

GUARD-RAILS ASSEMBLY

CROSS-REFERENCE TO RELATED APPLICATION

This application is a continuation-in-part of U.S. application, Ser. No. 962,553, filed Nov. 20, 1978 and now abandoned.

BACKGROUND OF THE INVENTION

1. Field of the Invention

This invention is directed toward an improved railing. The invention is also directed toward a method for assembling the improved railing.

2. Description of the Prior Art

The improved railing of the present invention is of the type having parallel upper and lower rails with bars extending perpendicularly between, and fixed to, the rails. These railings are now generally fabricated from light-weight metal extrusions and are constructed in a manner which permits rapid assembly of the components of the railing. Examples of this type of railing are shown in U.S. Pat. No. 4,014,520, issued Mar. 29, 1977, D. H. Walters inventor; and Canadian Pat. No. 778,130, issued Feb. 13, 1968. A. G. Bos inventor.

The known railings however are relatively expensive because of the number of different components required to construct the railing. In addition, many of the known railings are difficult to assemble and often require expensive tools or equipment in assembling the components.

SUMMARY OF THE INVENTION

It is the purpose of the present invention to provide an improved railing which is relatively inexpensive to manufacture.

It is a further purpose of the present invention to provide an improved railing which can be readily and inexpensively assembled, without the need of expensive tools or equipment.

In accordance with the present invention the railing is constructed from a minimum of components which can be readily assembled together with simple tools, or even manually without the need of any tools. The top and bottom rails of the railing are each constructed from the same two components which locate and lock the bars in place without the need of any separate fasteners.

The invention is particularly directed toward an improved railing having at least a rail and a plurality of bars extending perpendicularly between the rails. Each rail comprises an inner rail member and an outer rail member nested within the inner rail member. Both rail members are channel shaped having a web and flanges extending from the web. The web of the inner rail has openings through which the ends of the bars snugly pass. Cooperating means are provided on the ends of the bars and on the flanges of the outer rail members for connecting the bars and outer rail members together. Cooperating means are also provided on the flanges of the inner rail members, and on the outer rail members, for connecting the rail members together.

In another embodiment, the outer rail members are made in two longitudinal sections, each section having a web portion, and means for joining the web portions together to provide the channel shape.

The invention is also directed toward a method for assembling the improved railing which comprises first placing the ends of each railing bar through the openings in the webs of inner rail members and then attaching the outer rail members to the ends of the railing bars. Finally, the inner rail members are moved outwardly to receive the outer rail members in nesting relation, and the inner and outer rail members are attached together.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
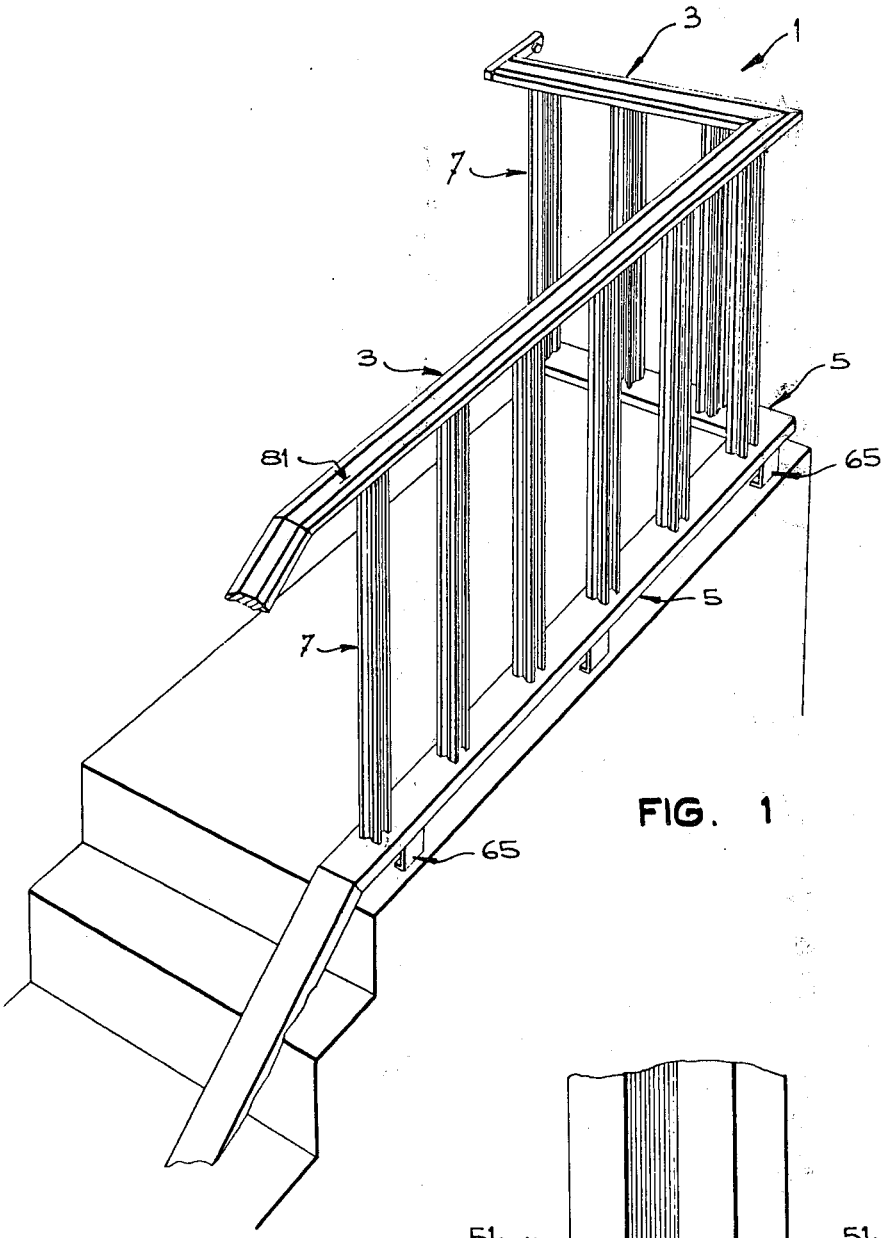
FIG. 1 is a perspective view of the assembled railing installed on a porch.
Figure 2:
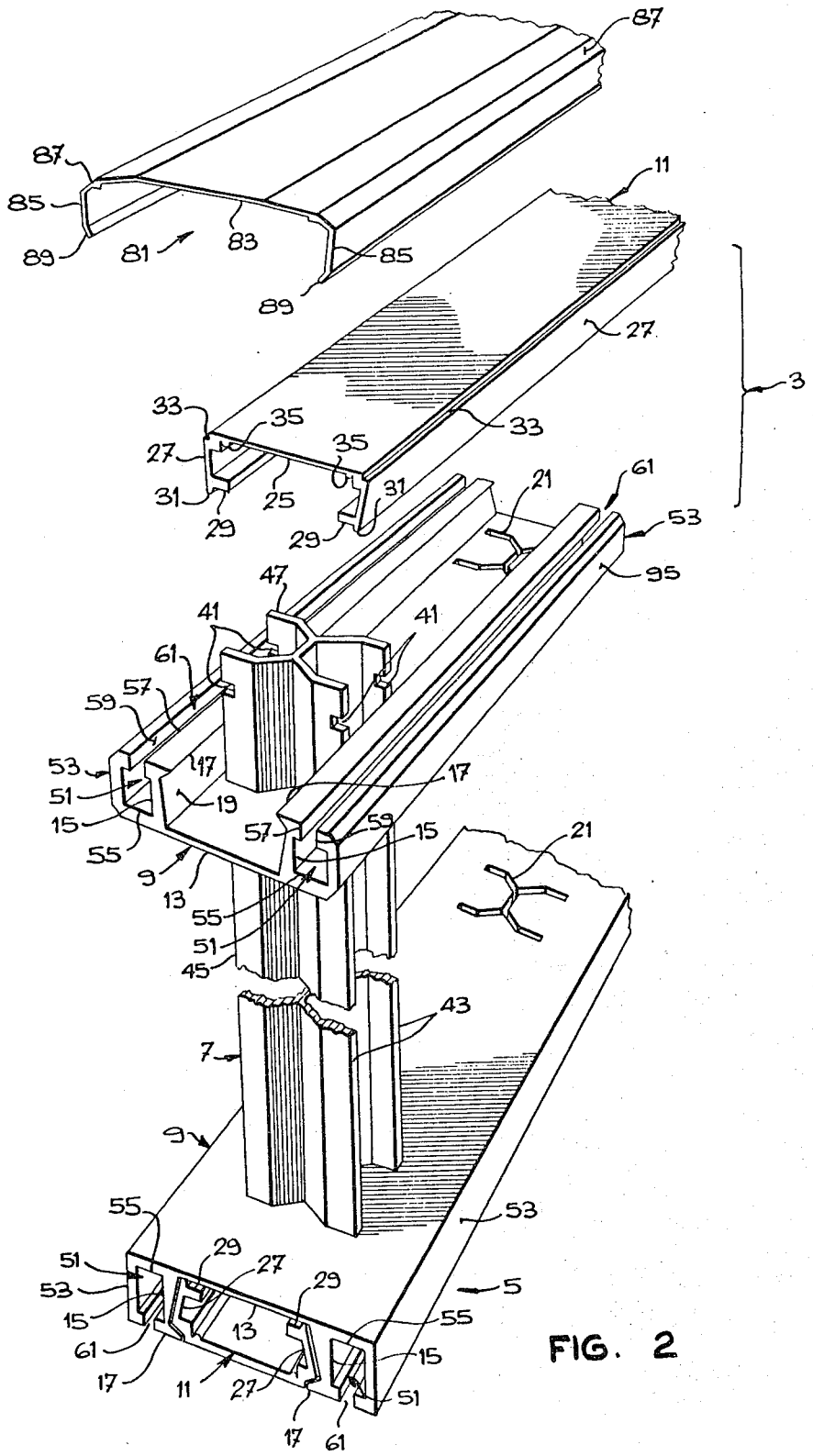
FIG. 2 is an exploded, detail view of the railing.
Figure 3:
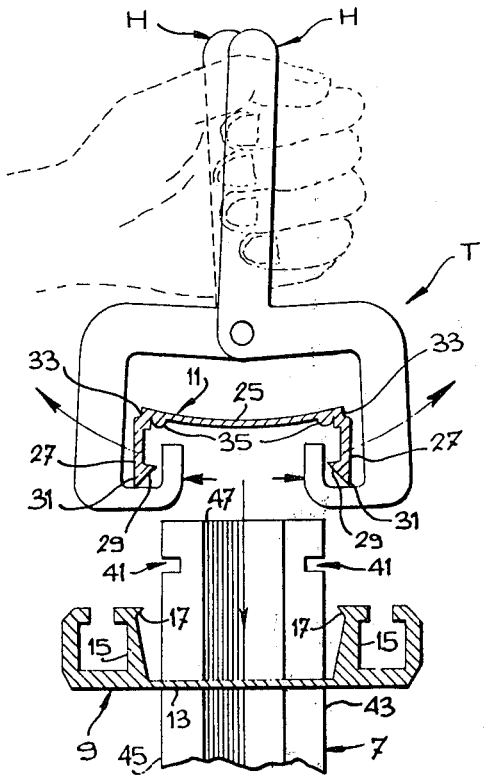
FIG. 3 is an end view showing a step in the assembly of the railing.

The assembled railing 1, as shown in FIG. 1 has two parallel main rails 3, 5 with a plurality of bars 7 extending perpendicularly between the rails. The rails 3, 5 are identical and each, as shown in FIG. 2, comprises an inner rail member 9 and an outer rail member 11. The inner and outer rail members 9, 11 are generally channel shaped and sized to have the outer rail member 11 nest within the inner rail member 9. The inner rail member 9 has a web 13 and a pair of flanges 15 extending outwardly from the web. Each flange 15 has an inwardly extending lip 17 at its end. The inner wall 19 of each flange 15 can angle outwardly slightly as shown in FIG. 3. A plurality of equally spaced apart openings 21 are provided in the web 13 of each inner rail member through each of which an end of a railing bar 7 snugly passes as will be described.

The outer rail member 11 also has a web 25 and a pair of flanges 27 extending outwardly therefrom. Each flange 27 has an inwardly extending lip 29 near its end 31. The flanges 27 preferably are angled slightly to slope toward each other. A recess 33 is provided at the bottom of each flange 27 adjacent the web 25. A seating rib 35 is also preferably provided on the inner surface of the web 25 adjacent each flange 27.

Each bar 7 can comprise a straight member having a roughly H-shaped cross-section. Slots 41 are provided in both sets of arms 43, 45 of the H-shaped bar member near its ends 47. The slots 41 on bar member 7 are located a distance from each end 47 equal to the distance the lips 29, on flanges 27, are located from ribs 35 on rail member 11. It will be seen that the openings 21 in the web 13 of the inner rail member 9 have the same configuration as the cross-section of the bar member 7 so that a snug, gap-free fit is obtained when the ends of the bar members 7 are inserted into the openings 21.

The inner and outer rail members 9, 11 and bars 7 are all preferably extruded from light-weight metal such as aluminum. In this embodiment, the webs 13, 25 in rail members 9, 11 respectively, are made quite thin, relative to the thickness of the flanges, so that they are flexible allowing them to bend transversely and thus allowing the flanges to be moved inwardly or outwardly as well.

The railing 1 is assembled from the bar and rail components 7, 9, 11 in the following manner. Both inner rail members 9 of the rails 3, 5 are first mounted on a plurality of bars 7. The ends 47 of each bar 7 are passed through openings 21 in both rail members 9 with each bar extending perpendicularly to the rail members 9.

Next, an outer rail member 11 has its flanges 27 moved outwardly, relative to web 25 as shown in FIG. 3. This outward movement of the flanges 27 can be accomplished with a plier-like tool "t" which, with its jaws "j", pulls the flanges 27 outwardly when the handles "h" are pulled together. The flanges 27 can move outwardly since the flexible web 25 gives and bows inwardly when force is applied outwardly to the flanges. With the flanges 27 spread apart, the rail member 11 can be moved down over the ends 47 of the bars 7 until ribs 35 abut ends 47, with the flanges 27 moved down the sides of arms 43, 45. The ribs 35 provide a clearance for the web 27 to bow inwardly when abutting the ends 47 of the bars 7. When tool "t" is removed by pushing its jaws "j" off the flanges 27, the flanges 27 move back inwardly and lips 29 slip into slots 41 to lock the rail member 11 to the bars. Both outer rail members 11 of rails 3, 5 are installed the same way.

Figure 4:
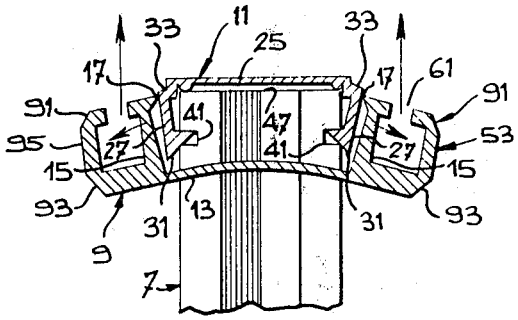
FIG. 4 is an end view showing another step in the assembly of the railing.

Now, for each rail 3, 5, the bar mounted inner rail member 9 is moved outwardly on the bars 7 toward the outer rail member 11. While moving the inner rail member 9 toward outer rail member 11, its flanges 15 are moved outwardly, preferably manually, about web 13 while the web 13 bows inwardly as shown in FIG. 4. With the flanges 15 moved outwardly, the lips 17 on the flanges 15 clear the ends 31 of the flanges 27 on outer rail member 11 and slide along the outer surface of the flanges 27 until they reach the recesses 33. Then the lips 17 snap into the recesses 33 to lock inner rail member 9 to nested outer rail member 11 as shown in FIG. 5.

The assembled railing 1 can be mounted in any manner on a balcony, porch or other structure where a railing is desired. Preferably the rails 3, 5 are provided with means for use in easily mounting the railing. These mounting means can comprise a pair of channels 51 in each inner rail 11 adjacent its flanges 15 as shown in FIG. 2. Each channel 51 is adjacent the outside of flange 15 and is defined on one side by the flange 15, and on the other side by an outer flange 53. The flanges 15, 53 are joined by a thick extension 55 of web 13. Lips 57, 59 can extend inwardly toward one another from the ends of flanges 15, 53 opposite web extension 55, defining a narrow slot 61 leading to the quadrangular shaped channel 51.

Figure 6:
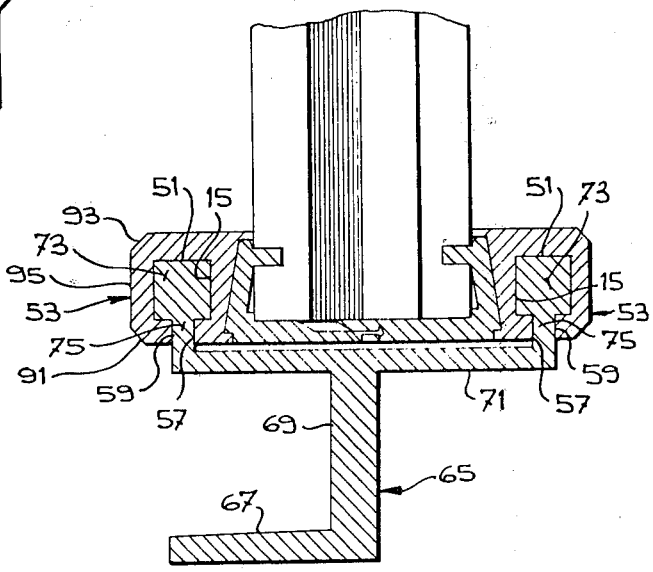
FIG. 6 appearing on the same sheet as FIG. 1, is a detail view showing the mounting of another embodiment of the railing.

The channels 51 in each rail 3, 5 open outwardly. Thus, those in the bottom rail 5 of railing 1 open downwardly. A plurality of brackets 65 can be used in association with channels 51 to mount the railing 1 as shown in FIGS. 1 and 6. Each mounting bracket 65 has a horizontal base leg 67, a vertical arm 69, and a horizontal platform 71 centrally located on the arm 69. Channel engaging sections 73 are fixed to each side of platform 71 by short support arms 75. Each bracket 65 slides onto the bottom of lower rail 5 from an open end of the rail with the sections 74 sliding into channels 51 and arms 75 sliding in slots 61. The platform 71 is located just below the rail 5 and the weight of the railing 15 carried through arm 69 to base 67 of platform 71 which fixed by suitable means (not shown) to the balcony or porch.

Figure 5:
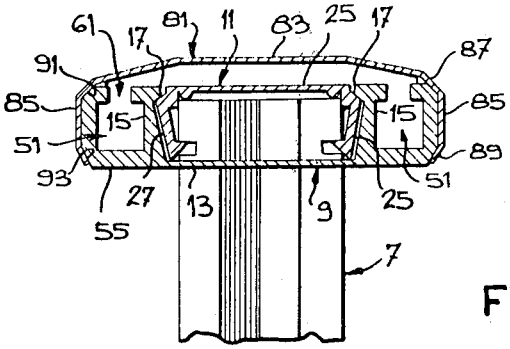
FIG. 5 is an end view of a portion of the assembled railing.

Preferably, the top rail 3 of the railing is covered with a cover 81 as shown in FIGS. 2 and 5. The cover 81 can be extruded from light-weight material such as aluminum and has a central web 83 with perpendicular side flanges 85. The flanges 85 can each be joined to web 83 with an angled corner section 87 and the end of each flange 85 can have an inturned lip 89. The cover 81 is relatively thin and flexible and it snaps in place on top rail 3 over the outside flanges 53 on inner rail member 11, covering the nested rail members 9, 11. Preferably the outer corners 91, 93 of the other flanges 53 on inner rail member 11 are bevelled to receive the section 87 and lip 89 respectively. The flange 85 on cover 81 has a length equal to the length of the straight side 95 of flange 53 on rail member 11. Thus the cover 81 is snugly held at its sides on the top rail 3.

Figure 9:
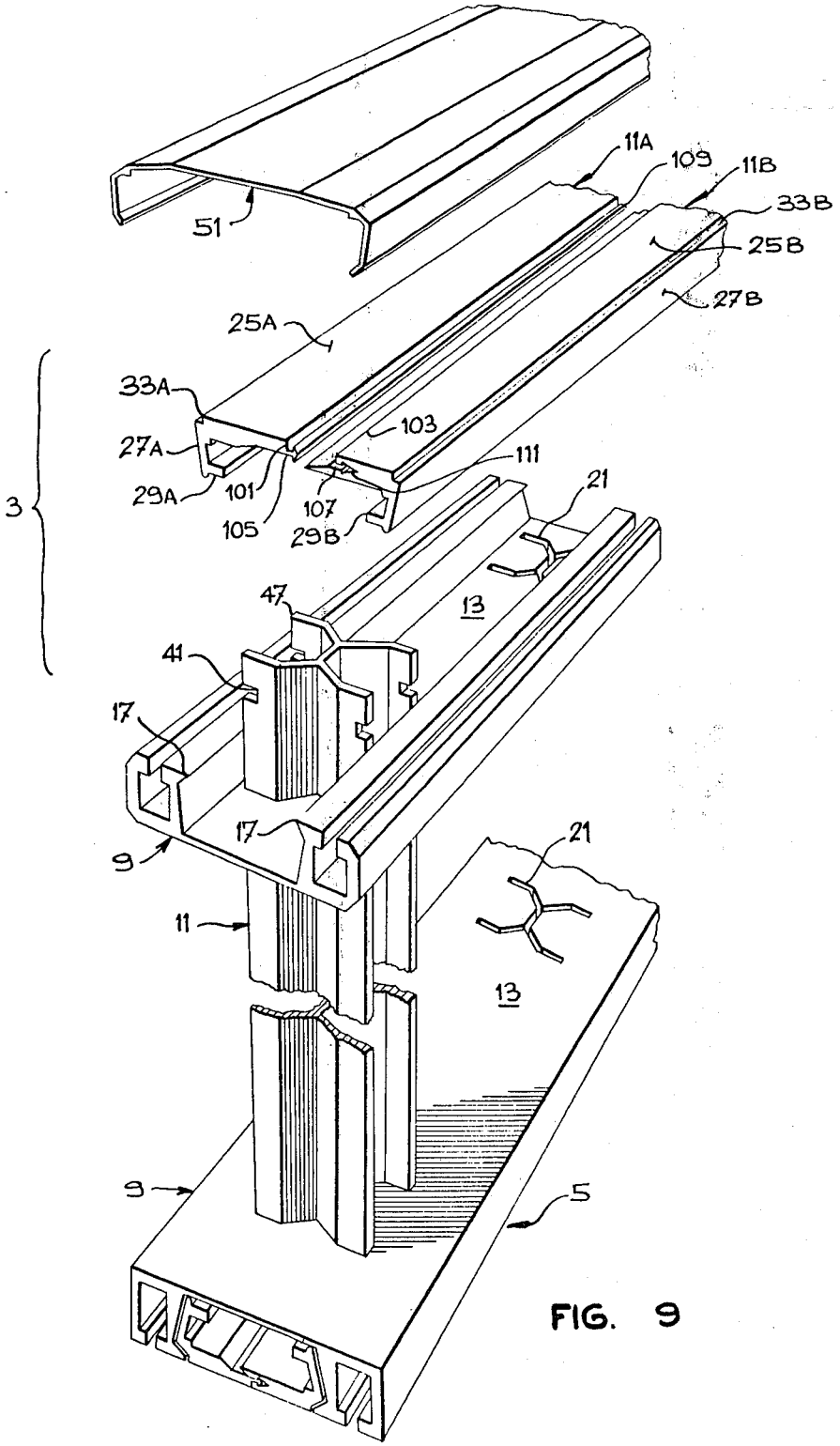
FIG. 9 is an exploded detail view, similar to FIG. 2, showing the other embodiment of the railing.

If desired, in another embodiment, the outer rail member 11 can be made in two sections **11*a*, 11*b* as shown in FIGS. 6 and 9. The sections 11*a*, 11*b* are joined together in the middle of the web 25. Section 11*a* has a flange 27*a*, an inturned lip 29*a* and a web portion 25*a*. Section 11*b* also has a flange 27*b*, an inturned lip 29*b* and a web portion 25*b*. Means are provided on the free edges 101, 103 of the web portions 25*a*, 25*b* for interlocking the sections 11*a*, 11*b* together. The interlocking means can comprise a projecting tongue 105 on the one section 11*a*, and a groove 107 on the other section 11*b*. The tongue 105 can have an arrowhead shaped tip 109 and the groove 107 can have a matching arrowhead-shaped recess 111 for receiving the tip 109. The tip 109 is forced into recess 111 to interlock the sections 11*a*, 11*b* together. In this embodiment, the web portions 25*a*, 25*b*** need not be so thin that they are flexible.

Making the outer rail member 11 in sections **11*a*, 11*b* permits the railing to be assembled without the need of any tools. As before, the bars 7 are first passed through openings 21 in the webs 13 of the inner rail members 9 of the rails 3,5. Then the sections 11*a*, 11*b* of the outer rail members 11 of the rails 3, 5 are assembled about the ends 47 of the ends of the bars. The sections 11*a*, 11*b* have their lips 29*a*, 29*b* inserted into the grooves 41 of the ends of the bars and at the same time locked together by pushing tongue 105 into groove 107. The inner rail members 9 are then pushed outwardly along the bars 7 to have the lips 17 on their flanges interlock with the recesses 33*a*, 33*b* on the interlocked, outer rail member sections 11*a*, 11*b***.

Figure 7:
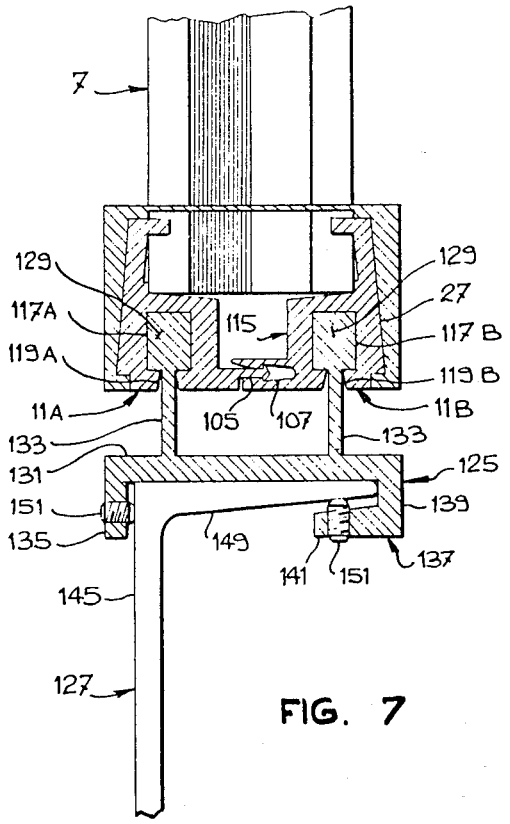
FIG. 7 is a detail view showing another mounting of the railing.

While the inner rail member 9 has been shown with mounting channels 51 therein for use in mounting the assembled railing 1, similar mounting channels could instead be provided in the outer rail members 11. As shown in FIG. 7, the depth of the outer rail members 11 is increased and a right angular wall 115 is provided at each corner between the flange 27 and web portion 25 of each section **11*a*, 11*b*. The wall 115 defines a channel 117 between it and the flange and web portions. A narrow slot 119 in the web portion 25 opens into the channel 117. The remainder of the rail construction is generally as before. In this embodiment mounting brackets, similar to mounting brackets 65, but sized to fit the closer channels 117** can be used to mount the railing.

In an alternative embodiment, a mounting bracket 125 is shown in FIG. 7 for mounting the railing in a flanged member 127. The bracket 125 has a pair of channel engaging sections 129 connected to a mounting plate 131 with arms 133 which pass through the narrow slots 119. The mounting plate 131 is provided with mounting flanges 135, 137 at its sides. The mounting flange 135 is straight and extends perpendicular from the plate 131. The mounting flange 137 is right angular and has an arm 139 which extends perpendicular from the plate 131 and a lip 141 which extends perpendicular from arm 139 toward the flange 135. The flange 135 bears against the web 145 of flanged member 127 and the flange 137 hooks under the end of the flange 149 of flanged member 127. Screws 151 in flanges 135 and 137 lock the member to the member 127. While the outer rail member 11 having the channels 117 is shown to be in sections 11*a*, 11*b* it could also be in one piece having a flexible central web, although in this case the web would have to be very thin to provide the needed flexibility because it is narrow.

Figure 8A:
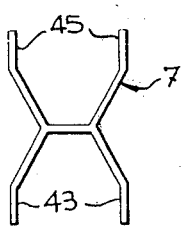
FIGS. 8*a*, 8*b*, 8*c* are cross-section views of different railing bars.
Figure 8B:
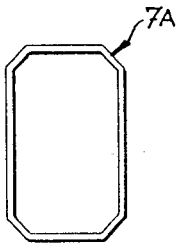
Figure 8C:
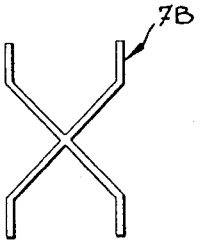

The bars 7 can have cross-sectional shapes other than the H-shaped cross-section described and shown in FIG. 8*a*. As shown in FIGS. 8*b* or 8*c* the bars 7*a* or 7*b* can be rectangular or X-shaped in cross-section. The openings 21 in the web 13 of the inner rail members 9 always have a shape matching the cross-sectional shape of the bars 7.

The railing 1 can be made in linear sections, suitably joined together to extend in a straight line, or at an angle to each other. The ends of the sections can be capped by suitable means. With slight modifications, the railing can be employed on stairs as well. The construction of the railing is such that it can also be readily disassembled if needed.

Figure 10:
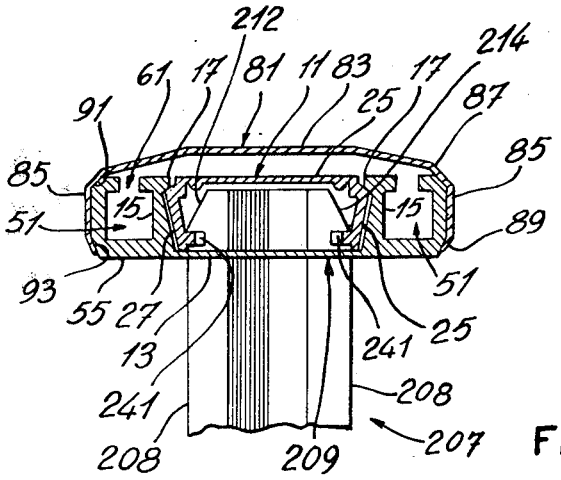
FIG. 10 is an end view similar to FIG. 5 showing a different embodiment thereof.

Referring now to FIG. 10 the bar 207 is shown having edges 208 interrupted by recesses 241 near the end 247 of the bar 207. The edges 208 of the bar are bevelled at 212 and 214 such that the width of the end 247 is narrower than the opening defined between the flanges 25 and 27. Accordingly, when it is necessary to assemble the railing, the rail member 11 is merely pressed downwardly onto the end of the bars 207. The edges of the flanges will ride on the bevel portions 212 and 214 until the lips 29 snap into the recesses 241. This arrangement obviates the use of the tool "t" shown in FIG. 3.

I claim:

1. An improved railing having at least a rail and a plurality of bars extending perpendicularly to the rail; the rail having an inner rail member and an outer rail member nested within the inner rail member; each inner and outer rail member being channel shaped with a web and flanges extending from the web; the web of the inner rail having spaced-apart openings through which the ends of the bars pass snugly; cooperating means on the ends of the bars and on the flanges of the outer rail member for engaging slots near the ends of the bars and outer rail members together and cooperating means on the flanges of the inner rail members and on the outer rail members for connecting the rail members together in nesting relation, wherein the outer rail member is made in two longitudinal sections, each section having a web portion, and means for joining the web portions together to provide the channel shape.

2. An improved railing having at least a rail and a plurality of bars extending perpendicularly to the rail; the rail having an inner rail member and an outer rail member nested within the inner rail member; each inner and outer rail member being channel shaped with a web and flanges extending from the web; the web of the inner rail having spaced-apart openings through which the ends of the bars pass snugly; cooperating means on the ends of the bars and on the flanges of outer rail member for engaging the slots near the ends of the bars and outer rail members together and cooperating means on the flanges of the inner rail members and on the outer rail members for connecting the rail members together in nesting relation, and a cover for one of the rails having means for connecting it to one inner rail member while covering the nested outer rail member.

3. An improved railing comprising a plurality of bars mounted to a face member, a rail member connected to the bars, the rail member including a first inner extrusion comprising a web and a pair of upstanding flanges, a plurality of bar receiving holes spaced apart in the web, a second extrusion member comprising a web and a pair of downwardly extending flanges, the downwardly extending flanges of the second extrusion being adapted to fit between the upstanding flanges of the first extrusion and the upstanding bars including notches in opposed side walls thereof facing the flanges, the second extrusion including ribs extending inwardly of the ends of the flanges and adapted to engage the notches provided in the bars near the ends thereof and notches provided on the outer surface of the flanges of the second extrusion adapted to receive cooperating ribs provided on the inner surface of the upstanding flanges of the first extrusion so as to connect the first extrusion to the second extrusion while the second extrusion is connected to the bar, and wherein the first extrusion is provided with a pair of channel members defined by the upstanding flanges and a pair of spaced parallel exterior flanges.

4. A method for use in assembling a railing composed of a rail and a plurality of bars, the rail including an inner and an outer channel-shaped rail member, comprising passing the ends of the bars through openings in the webs of the inner rail members, force fitting the flanges of the outer rail member to engage cooperating means at the ends of the bars, and moving the inner rail members outwardly along the bars to nestingly receive and be connected to outer rail members, wherein the outer rail members are each made in two longitudinal sections and the method includes joining the sections together to form the channel shape while connecting them to the outer ends of the bars.

* * * * *